US008251029B2

(12) United States Patent
Kurisu et al.

(10) Patent No.: US 8,251,029 B2
(45) Date of Patent: Aug. 28, 2012

(54) VALVE TIMING CONTROLLER

(75) Inventors: Masao Kurisu, Kariya (JP); Taei Sugiura, Anjo (JP)

(73) Assignee: Denso Corporation, Kariya (JP)

( * ) Notice: Subject to any disclaimer, the term of this patent is extended or adjusted under 35 U.S.C. 154(b) by 351 days.

(21) Appl. No.: 12/687,393

(22) Filed: Jan. 14, 2010

(65) Prior Publication Data

US 2010/0180845 A1 Jul. 22, 2010

(30) Foreign Application Priority Data

Jan. 21, 2009 (JP) ..... 2009-11314

(51) Int. Cl.
*F01L 1/34* (2006.01)

(52) U.S. Cl. ..... 123/90.17; 132/90.15; 132/90.34; 464/160

(58) Field of Classification Search ..... 123/90.15, 123/90.17, 90.34; 464/160
See application file for complete search history.

(56) References Cited

U.S. PATENT DOCUMENTS

| | | | |
|---|---|---|---|
| 6,981,478 | B2 | 1/2006 | Schäfer et al. |
| 7,341,030 | B2 | 3/2008 | Hori et al. |
| 7,624,710 | B2 | 12/2009 | Uehama et al. |

FOREIGN PATENT DOCUMENTS

| | | |
|---|---|---|
| JP | 2007-071056 | 3/2007 |
| JP | 2007-239642 | 9/2007 |
| JP | 2008-223552 | 9/2008 |

OTHER PUBLICATIONS

Japanese Office Action dated Jan. 6, 2011 issued in corresponding Japanese Application No. 2009-011314 with English Translation.

*Primary Examiner* — Ching Chang
(74) *Attorney, Agent, or Firm* — Nixon & Vanderhye PC

(57) ABSTRACT

A valve timing controller is provided with a driving rotor rotating along with a crankshaft, a driven rotor rotating along with a camshaft, a planetary gear performing a planetary motion to adjust a rotational phase between the camshaft and the crankshaft, a motor shaft rotating for controlling the planetary motion, a cylindrical planetary carrier supporting the planetary gear and being connected with the control shaft so that the planetary gear performs the planetary motion, and a lubricating mechanism. The lubricating mechanism includes an introducing port which opens on a side surface of the second rotor axially confronting the planetary carrier. The introducing port extends across a supporting outer surface and a connecting inner surface. The lubricant is introduced into an interior of the first rotor through the introducing port.

9 Claims, 12 Drawing Sheets

VALVE TIMING CONTROLLER

CROSS-REFERENCE TO RELATED APPLICATION

This application is based on Japanese Patent Application No. 2009-11314 filed on Jan. 21, 2009, the disclosure of which is incorporated herein by reference.

FIELD OF THE INVENTION

The present invention relates to a valve timing controller which adjusts valve timing of a valve that is opened/closed by a camshaft driven by a torque transmitted from a crankshaft of an internal combustion engine.

BACKGROUND OF THE INVENTION

A valve timing controller has two rotors which rotate in synchronization with a crankshaft and a camshaft respectively. One of two rotors is provided with a gear portion engaging with a planetary gear. The planetary gear performs a planetary motion, so that a relative rotational phase between the crankshaft and the camshaft is adjusted. This relative rotational phase is referred to as a rotational phase, hereinafter.

JP-2007-71056A shows a valve timing controller which has a lubricant introducing port provided to the rotor rotating with the camshaft. The lubricant is introduced to an outer periphery of a tubular planetary carrier which supports a planetary gear. Thus, the lubricant is easily introduced into an engaging interface between the planetary gear and the gear portion, so that abrasion at the engaging interface is reduced.

Further, JP-2007-71056A also shows a configuration of the valve timing controller having another lubricant introducing port for introducing the lubricant to an interior of the tubular planetary carrier. The lubricant is easily introduced into a connecting interface between an inner periphery surface of the planetary carrier and a control shaft which rotatably drives the planetary carrier, so that abrasion at the connecting interface is reduced.

In the above configuration of the valve timing controller, two lubricant introducing ports are necessary to lubricate both of the engaging interface and the connecting interface. This is because the engaging interface and the connecting interface are apart from each other in a radial direction of the rotor. Two lubricant introducing ports may complicate a lubricant introducing structure, which may cause a deterioration in productivity or an increase in productive cost.

SUMMARY OF THE INVENTION

The present invention is made in view of the above matters, and it is an object of the present invention to provide a valve timing controller which can improve a lubrication property thereof with a simple lubricating structure.

According to one aspect of the present invention, a valve timing controller adjusts a valve timing of a valve opened/closed by a torque transmitted from a crankshaft to a camshaft of an internal combustion engine. The valve timing controller includes a first rotor rotating along with one of the crankshaft and the camshaft, a second rotor accommodated in the first rotor and rotating along with the other of the crankshaft and the camshaft, and a planetary gear accommodated in the first rotor and having an external gear engaging with an internal gear provided to the first rotor or the second rotor. The planetary gear performs a planetary motion to adjust a relative rotational phase between the crankshaft and the camshaft.

The valve timing controller further includes a control shaft rotating for controlling the planetary motion, and a cylindrical planetary carrier accommodated in the first rotor. The planetary carrier includes a supporting outer surface which supports the planetary gear thereon, and a connecting inner surface to which the control shaft is connected so that the planetary gear performs the planetary motion according to a rotation of the control shaft.

Further, the valve timing controller includes a lubricating mechanism having an introducing port which opens on a side surface of the second rotor axially confronting the planetary carrier. The introducing port extends across the supporting outer surface and the connecting inner surface in order to introduce a lubricant into an interior of the first rotor therethrough.

According to the above configuration, the lubricant can be introduced from the introducing port into an engaging interface between the planetary carrier and the gear portion and a connecting interface between the planetary carrier and the control shaft without respect to their positions. Thus, the high lubricating property can be performed to reduce abrasion at the engaging interface and the connecting interface by a lubricating mechanism having the introducing port.

According to another aspect of the present invention, the introducing port has a first side-opening radially extending across the supporting outer surface of the planetary carrier. The lubricant can be introduced to an engaging interface between the planetary gear and the gear portion which locates radially outside of the supporting outer surface. Thus, the lubricating property can be enhanced by a simple lubricating mechanism.

According to another aspect of the present invention, the supporting outer surface is an eccentric surface with respect to the second rotor, and the first side-opening of the introducing port extends radially outward over a maximum eccentric point of the supporting outer surface. The lubricant can be always introduced to the engaging interface which locates radially outside of the maximum eccentric point. Thus, the lubricating property can be further enhanced by a simple lubricating mechanism.

According to another aspect of the present invention, the introducing port has a first side-opening radially extending across the connecting inner surface. The lubricant is surely introduced to the connecting interface between the control shaft and the connecting inner surface of the planetary carrier. Thus, the lubricating property can be enhanced by a simple lubricating mechanism.

According to another aspect of the present invention, a valve timing controller further includes a fastening member fastening the second rotor to the camshaft. The first rotor rotates along with the crankshaft, and the second rotor rotates along with the camshaft. The second rotor is provided with a through-hole through which the fastening member is inserted. The introducing port has a first side-opening confronting the planetary carrier and a radially inside opening communicating with the through-hole. Thus, the lubricant can be introduced into an inner surface of the through-hole.

According to another aspect of the present invention, the introducing port has a bottom portion located radially outward relative to the radially inside opening and the supporting outer surface. Thus, the lubricating property can be enhanced at the connecting inner surface and the supporting outer surface.

According to another aspect of the present invention, a valve timing controller further includes a locating member for locating the second rotor with respect to the camshaft which the second rotor rotates along with. The locating member is inserted into the introducing port. The introducing port has a function of introducing the lubricant and a function of locating the second rotor. Thus, the configuration including the lubricating configuration can be simplified.

According to another aspect of the present invention, the introducing port defines a space into which a lubricant flows. Thus, the lubricant is surely introduced into the interior of the first rotor through the space and the side opening.

According to another aspect of the present invention, the first rotor rotates along with the crankshaft, the second rotor rotates along with the camshaft, and the introducing port has a second side-opening confronting the first rotor. The second side-opening radially extends across a supporting interface between the first rotor and the camshaft. Thus, the lubricant can be introduced not only to the engaging interface and the connecting interface, but also to the supporting interface.

According to another aspect of the present invention, the lubricating mechanism includes an annular groove provided on a side surface of the second rotor. The annular groove extends in a rotational direction of the second rotor and introduces the lubricant to the supporting interface. Thus, the lubricant can be introduced to an entire supporting interface between the first rotor and the camshaft.

According to another aspect of the present invention, the annular groove has an annular opening extending across the supporting interface. Thus, the lubricant can be surely introduced to the entire supporting outer surface.

According to another aspect of the present invention, the annular groove communicates with a lubricant passage provided in the camshaft through which a lubricant flows. The annular groove introduces the lubricant from a lubricant passage to the introducing port, and a communication point between the lubricant passage and the annular groove circumferentially deviates from the introducing port. Thus, even if the annular groove is clogged with foreign matters in one half of annular groove, the lubricant can be introduced to the introducing port through the other half of annular groove. It can be avoided that the lubricating property is deteriorated due to a fault in the lubricating configuration.

According to another aspect of the present invention, the camshaft and the first rotor define a supporting interface therebetween, and the second rotor and the first rotor defines a sliding interface therebetween. The sliding interface radially extends from the supporting interface. The lubricant introduced to the supporting interface is further introduced to the sliding interface.

According to another aspect of the present invention, the valve timing controller further includes a ball bearing between the supporting outer surface of the planetary carrier and the planetary gear. Since the introducing port extends across the connecting inner surface and the supporting outer surface of the planetary carrier, the lubricant can be introduced to the ball baring.

According to another aspect of the present invention, the first rotor is provided with a first gear portion, the second rotor is provided with a second gear portion, and the planetary gear is provided with a third gear portion and a fourth gear portion which respectively engage with the first gear portion and the second gear portion. The lubricant is introduced from the introducing port to an engaging interface between the second gear portion and the fourth gear portion and the other engaging interface between the first gear portion and the third gear portion.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
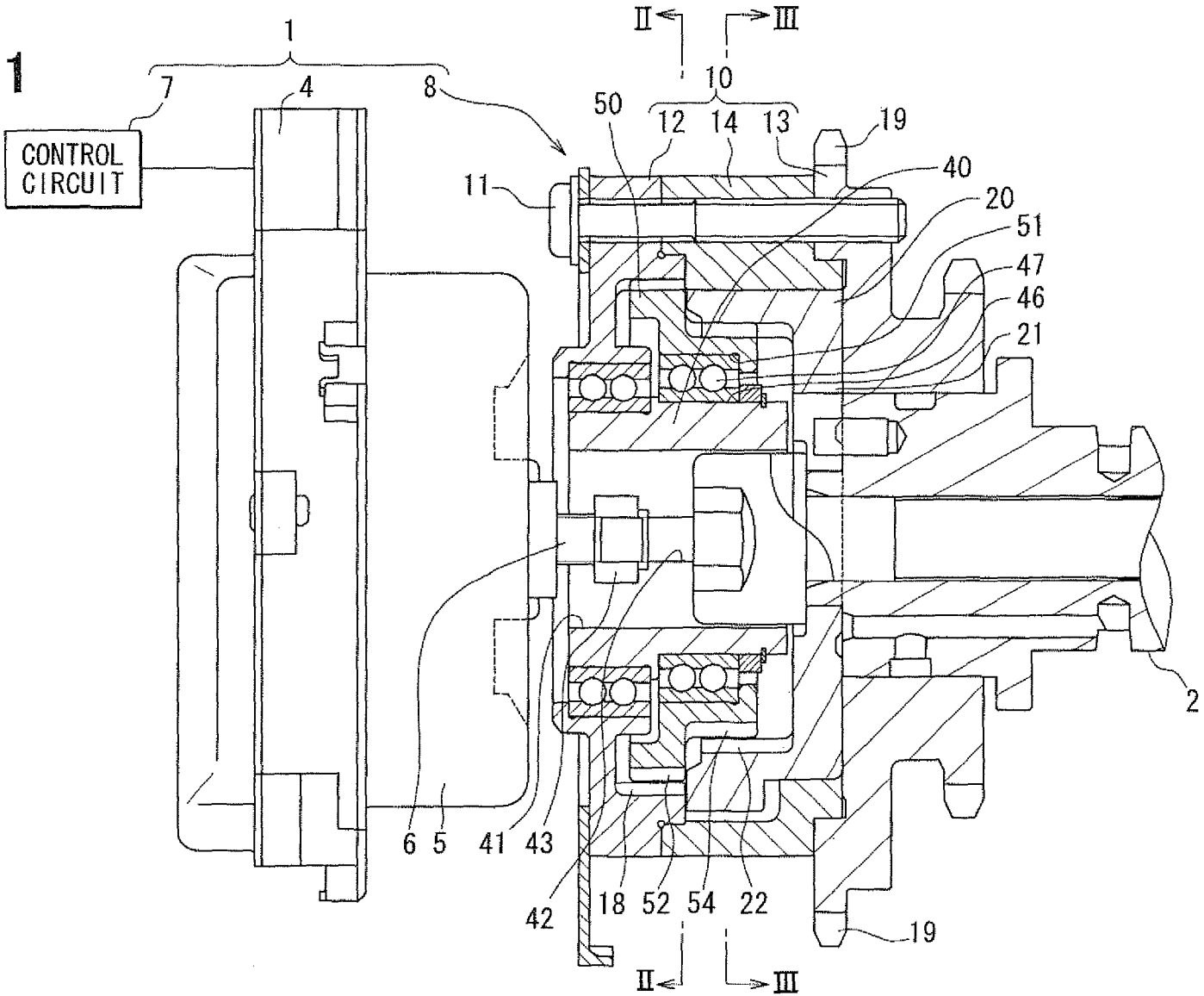
FIG. 1 is a cross-sectional view taken along a line I-I in FIG. 2 illustrating a basic configuration of a valve timing controller according to a first embodiment of the present invention.

Multiple embodiments of the present invention will be described with reference to accompanying drawings. In each embodiment, the same parts and the components are indicated with the same reference numeral and the same description will not be reiterated.

First Embodiment

FIG. 1 shows a valve timing controller 1 according to a first embodiment of the present invention. The valve timing controller 1 is mounted on a vehicle, and more specifically, the valve timing controller 1 is mounted on a transmission system that transmits an engine torque from a crankshaft (not shown) to a camshaft 2 of an internal combustion engine. It should be noted that in the present embodiment the camshaft 2 opens and closes an intake valve (not shown) that serves as a "valve" of the internal combustion engine through transmission of the engine torque. The valve timing controller 1 adjusts a rotational phase between the crankshaft and the camshaft 2 to get a desired valve timing of the intake valve.

(Basic Configuration)

A basic configuration of the valve timing controller 1 of the first embodiment will be described below. The valve timing controller 1 includes an electric actuator 4, an energizing control circuit unit 7, and a phase adjusting mechanism 8.

The electric actuator 4 is, for example, a brushless motor, and includes a motor case 5 and a motor shaft (control shaft)

6. The motor case 5 is fixed to a fixation part of an internal combustion engine, which is immovable relative to the engine, and the motor shaft 6 is supported by the motor case 5 rotatably in normal and reverse directions. The energizing control circuit unit 7 includes a driver and a microcomputer that controls the driver. The energizing control circuit unit 7 is provided outside and/or inside the motor case 5, and is electrically connected with the electric actuator 4. The energizing control circuit unit 7 energizes the electric actuator 4 and controls a rotation of the motor shaft 6 to adjust the rotational phase according to a driving condition of the internal combustion engine.

Figure 2:
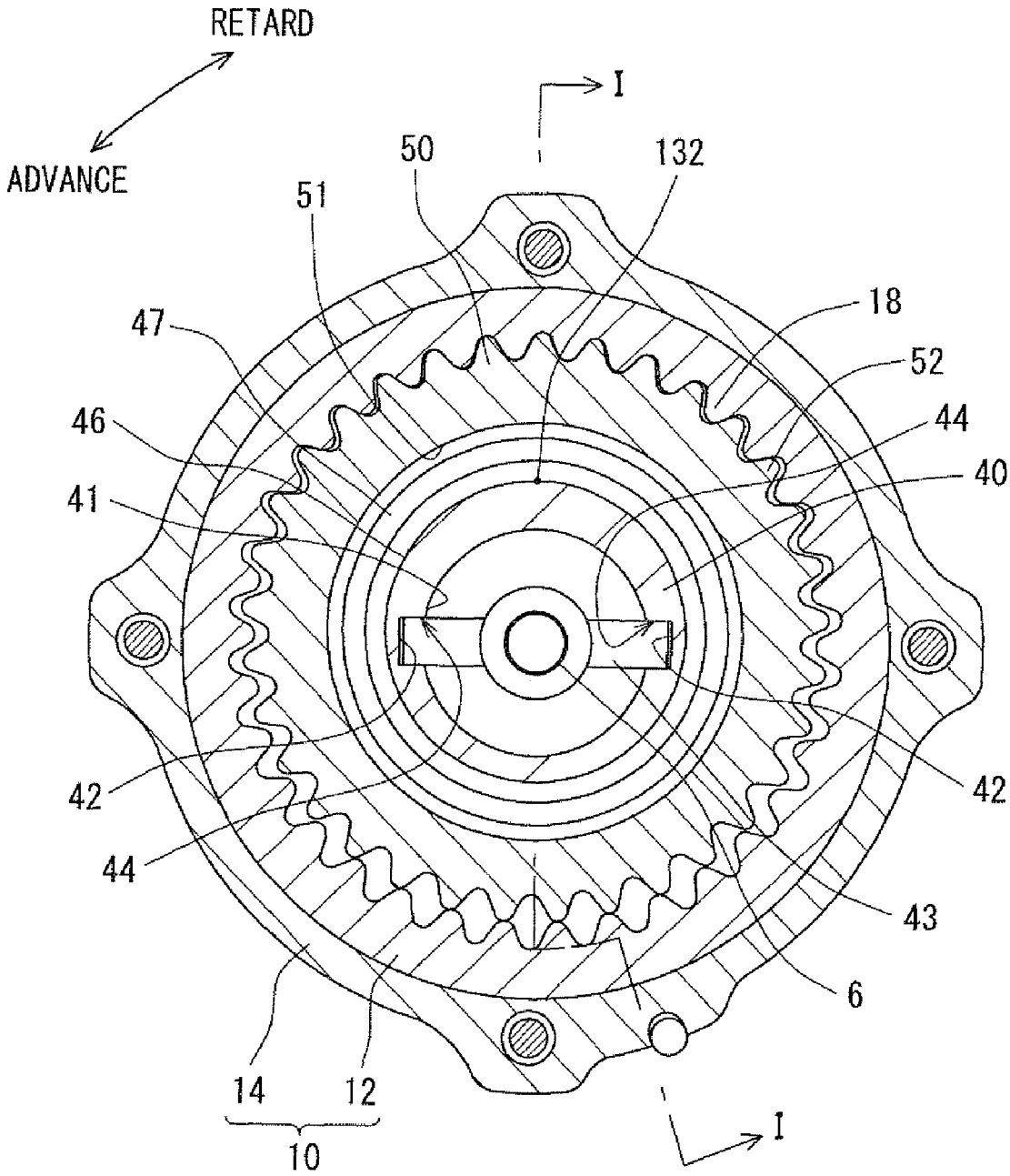
FIG. 2 is a cross-sectional view taken along a line II-II in FIG. 1.
Figure 3:
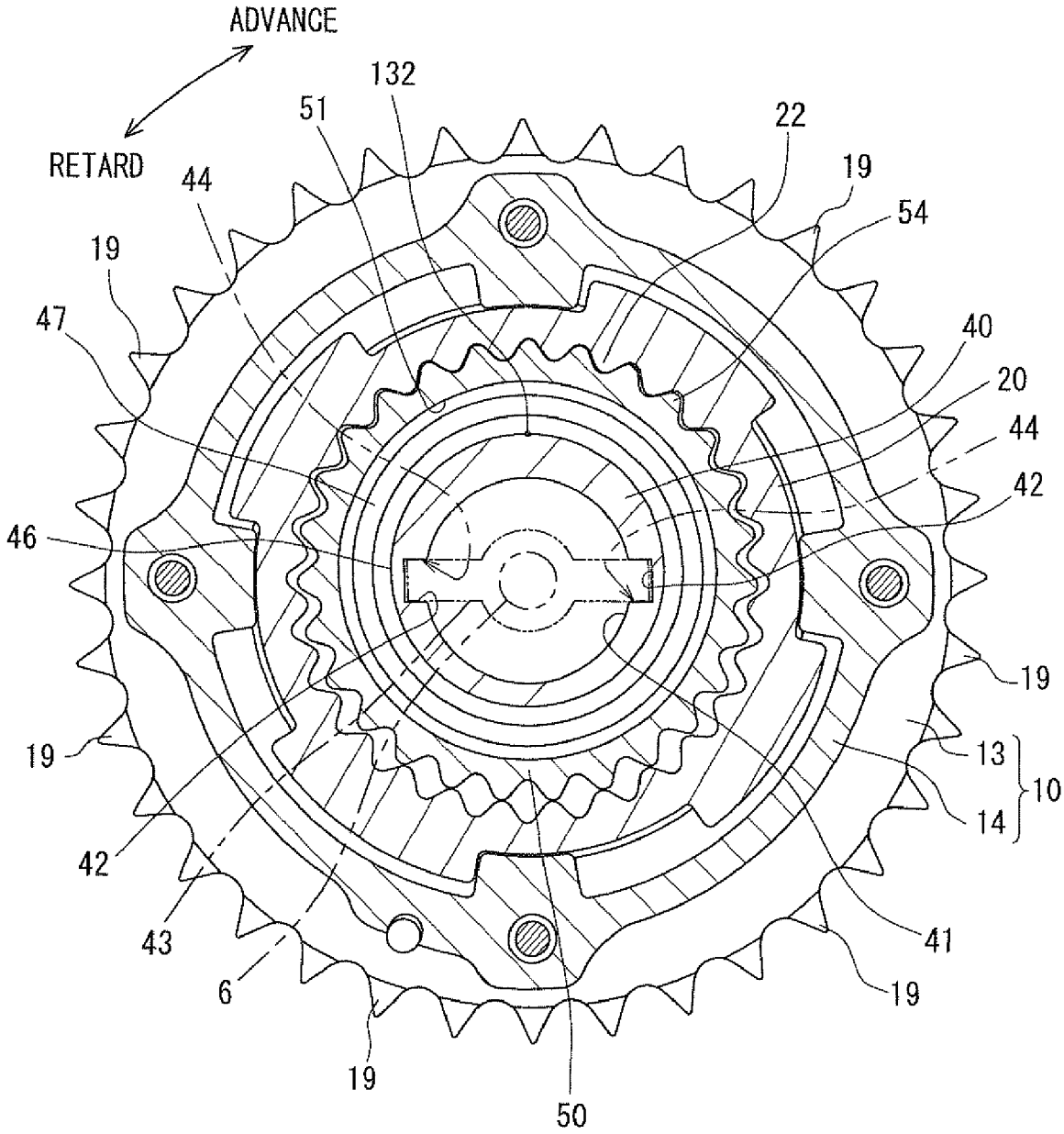
FIG. 3 is a cross-sectional view taken along a line III-III in FIG. 1.

The phase adjusting mechanism 8 is provided with a driving rotor 10, a driven rotor 20, a planetary carrier 40, and a planetary gear 50, As shown in FIGS. 1 to 3, the driving rotor 10 generally has a tubular shape and accommodates the driven rotor 20, the planetary carrier 40 and the planetary gear 50. The driving rotor 10 is comprised of a gear member 12, a sprocket member 13, and a tubular member 14, which are coaxially connected with each other by a bolt 11.

As shown in FIGS. 1 and 2, the gear member 12 includes a driving-side internal gear 18 on its radially inner peripheral wall. The driving-side internal gear 18 defines an addendum circle located on a radially inner side of a root circle. As shown in FIGS. 1 and 3, the sprocket member 13 has a plurality of gear teeth 19 on its outer periphery. A timing chain (not shown) is wound around the gear teeth 19 of the sprocket member 13 and a plurality of gear teeth of the crankshaft so that the sprocket member 13 is linked to the crankshaft. When the engine torque is transmitted from the crankshaft to the sprocket member 13 through the timing chain, the driving rotor 10 rotates in accordance with the crankshaft. A rotation direction of the driving rotor 10 is a counterclockwise direction in FIG. 2, and a clockwise direction in FIG. 3.

As shown in FIGS. 1 and 3, the driven rotor 20 is coaxially arranged in the tubular member 14. The driven rotor 20 has a connection portion 21 on a bottom wall portion thereof. The connection portion 21 is coaxially coupled with the camshaft 2. This coupling enables the driven rotor 20 to rotate synchronously with the camshaft 2 and to rotate relatively with respect to the driving rotor 10. The rotational direction of the driven rotor 20 corresponds to the clockwise direction in FIG. 3 similar to the driving rotor 10.

The driven rotor 20 includes a driven-side internal gear 22 on its radially inner peripheral wall, and the driven-side internal gear 22 defines an addendum circle located on a radially inner side of a root circle. The driven-side internal gear 22 has an inner diameter smaller than an inner diameter of the driving-side internal gear 18, and the number of teeth of the driven-side internal gear 22 is smaller than the number of teeth of the driving-side internal gear 18. The driven-side internal gear 22 is positioned away from the driving-side internal gear 18 in an axial direction.

As shown in FIGS. 1 to 3, the planetary carrier 40 generally has a tubular shape and has a connecting inner surface 41 which corresponds to an inner peripheral surface thereof. The connecting inner surface 41 is coaxial with respect to the rotors 10, 20 and the motor shaft 6. The connecting inner surface 41 has two engage grooves 42 which respectively receive joint portions 43 provided on the motor shaft 6. This engagement enables the planetary carrier 40 to rotate along with the motor shaft 6 and to perform a relative rotation with respect to the driving-side internal gear 18. It should be noted that a connecting interface 44 between the engage grooves 42 and the joint portions 43 absorbs an axial center deviation between the motor shaft 6 and the planetary carrier 40.

As shown in FIGS. 1 to 3, the planetary carrier 40 generally has a tubular shape and has a supporting outer surface 46 which corresponds to an outer peripheral surface thereof. The supporting outer surface 46 is an eccentric surface with respect to the rotors 10, 20 and the motor shaft 6. The supporting outer surface 46 supports the planetary gear 50 through a ball bearing 47 in such a manner that the planetary gear performs a planetary motion. The ball bearing 47 is arranged between the supporting outer surface 46 and an inner peripheral surface 51 of the planetary gear 50. The planetary gear 50 rotates about an eccentric axis of the supporting outer surface 46, and also the planetary gear 50 revolves relative to the planetary carrier 40, The planetary gear 50 has a shouldered hollow cylindrical shape, and more specifically, the planetary gear 50 has a driving-side external gear 52 and a driven-side external gear 54 on its outer periphery surface. The driving-side external gear 52 is arranged in such a manner as to engage with the driving-side internal gear 18. Also, the driven-side external gear 54 is arranged in such a manner as to engage with the driven-side internal gear 22. The driven-side external gear 54 has an outer diameter smaller than that of the driving-side external gear 52. The number of gear teeth of the driven-side external gear 54 and the driving-side external gear 52 is smaller than the number of teeth of the driven-side internal gear 22 and the driving-side internal gear 18 by the same number of gear teeth.

As described above, the phase adjusting mechanism 8 converts the rotational motion of the planetary carrier 40 into the planetary motion of the planetary gear 50, whereby the rotational phase is varied to adjust the valve timing.

Specifically, in a case where the motor shaft 6 rotates at the same speed as the driving rotor 10, the planetary carrier 40 does not rotate relative to the driving-side internal gear 18, so that the external gears 52, 54 of the planetary gear 50 does not perform the planetary motion but rotates along with the rotors 10 and 20. Accordingly, the rotational phase is not varied to hold the valve timing. Meanwhile, in a case where the motor shaft 6 rotates at higher speed than the driving rotor 10, the planetary carrier 40 rotates in an advance direction relative to the driving-side internal gear 18, whereby the planetary gear 50 performs the planetary motion with the external gears 52, 54 engaged with the internal gears 18, 22. As a result, the driven rotor 20 relatively rotates in the advance direction with respect to the driving rotor 10 and the rotational phase is varied in the advance direction to advance the valve timing. Meanwhile, in a case where the motor shaft 6 rotates at lower speed than the driving rotor 10, or in a case where the motor shaft 6 counter-rotates with respect to the driving rotor 10, the planetary carrier 40 rotates in a retard direction relative to the driving-side internal gear 18, whereby the planetary gear 50 performs the planetary motion with the external gears 52, 54 engaged with the internal gears 18, 22. As a result, the driven rotor 20 relatively rotates in the retard direction with respect to the driving rotor 10 and the rotational phase is varied in the retard direction to retard the valve timing.

(Characteristic Configuration)

A characteristic configuration of the valve timing controller of the first embodiment will be described below.

Figure 4:
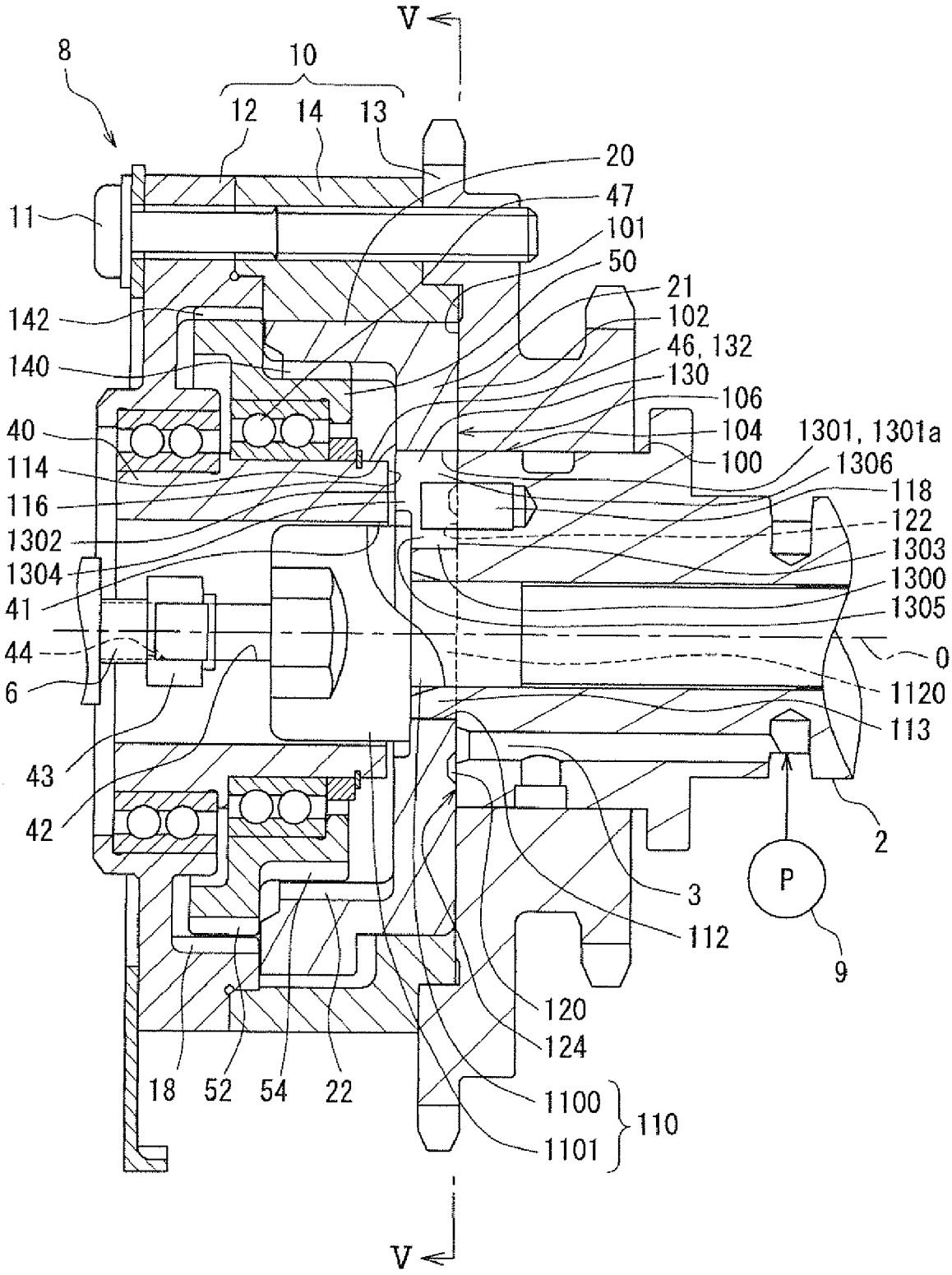
FIG. 4 is a cross-sectional view illustrating an enlarged phase adjustment mechanism in FIG. 1.

As shown in FIG. 4, the sprocket member 13 is coaxially engaged with a periphery surface 100 of the camshaft 2 in such a manner as to relatively rotate with respect to the camshaft 2. A side surface 101 of the sprocket member 13 confronts a side surface 102 of the driven rotor 20. In the present embodiment, the side surface 101 and the side surface 102 are slidably in contact with each other to perform a relative rotation. The side surface 101 of the sprocket member 13 is referred to as a sprocket-side-surface 101, and the side surface 102 of the driven rotor 20 is referred to as a driven-rotor-side-surface 102, hereinafter. A supporting interface 104 is defined between the driving rotor 10 and the camshaft 2 and a sliding interface 106 is defined between the sprocket-side-surface 101 and the driven-rotor-side-surface 102.

The connection portion 21 of the driven rotor 20 is provided with a through-hole 112 through which a fastening member 110 is inserted. The fastening member 110 is a bolt comprised of a shaft portion 1100 and a head portion 1101. The shaft portion 1100 is inserted into the through-hole 112 via a protruding end portion 113 of the camshaft 2 to be threadingly connected with the camshaft 2. The connection portion 21 is sandwiched between the head portion 1101 and the camshaft 2 to be connected with the camshaft 2 in the axial direction. An inner side surface 114 of the driven rotor 20 confronts an end surface 116 of the planetary carrier 40 in the axial direction. Moreover, a columnar locating pin 118 is inserted into the connection portion 21 to be engaged with the camshaft 2 so that the driven rotor 20 is positioned in a circumferential direction relative to the camshaft 2. The columnar locating pin 118 corresponds to a locating member of the present invention.

Figure 5:
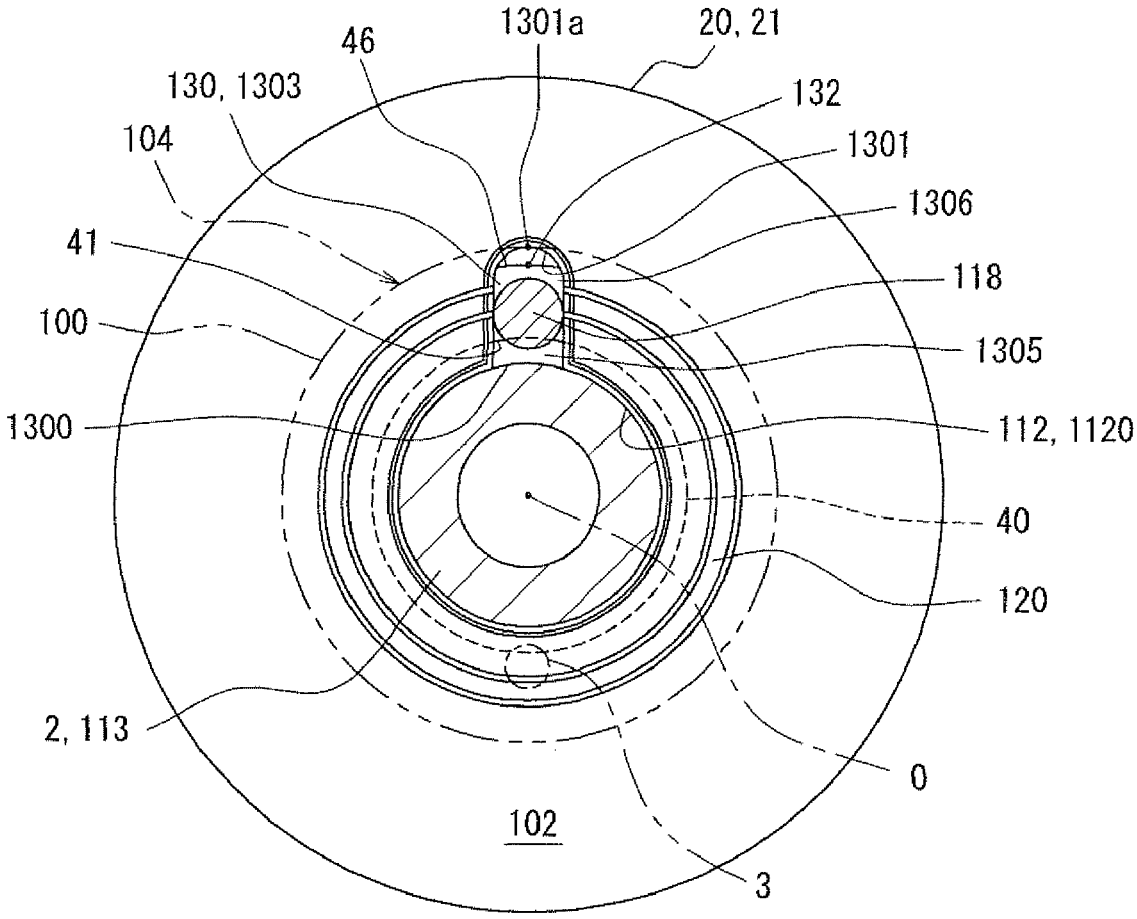
FIG. 5 is a cross-sectional view taken along a line V-V in FIG. 4, showing an essential part of the phase adjustment mechanism.

Furthermore, as shown in FIGS. 4 and 5, the connection portion 21 has an annular groove 120 extending in a rotational direction of the driven rotor 20. The annular groove 120 confronts the driven-rotor-side-surface 102 which defines the sliding interface 106 in cooperation with the sprocket-side-surface 101. The annular groove 120 is coaxial with respect to the camshaft 2. In the present embodiment, an outermost diameter of the annular groove 120 is smaller than a diameter of the periphery surface 100 of the camshaft 2, which defines the supporting interface 104 in cooperation with the sprocket member 13. Moreover, an innermost diameter of the annular groove 120 is larger than the inner diameter of the through-hole 112 into which the protruding end portion 113 of the camshaft 2 is inserted. The camshaft 2 has a stepped surface 122 which connects between the periphery surface 100 and an outer surface of the protruding end portion 113. The stepped surface 122 is in contact with the driven-rotor-side-surface 102 across the annular groove 120.

Figure 6:
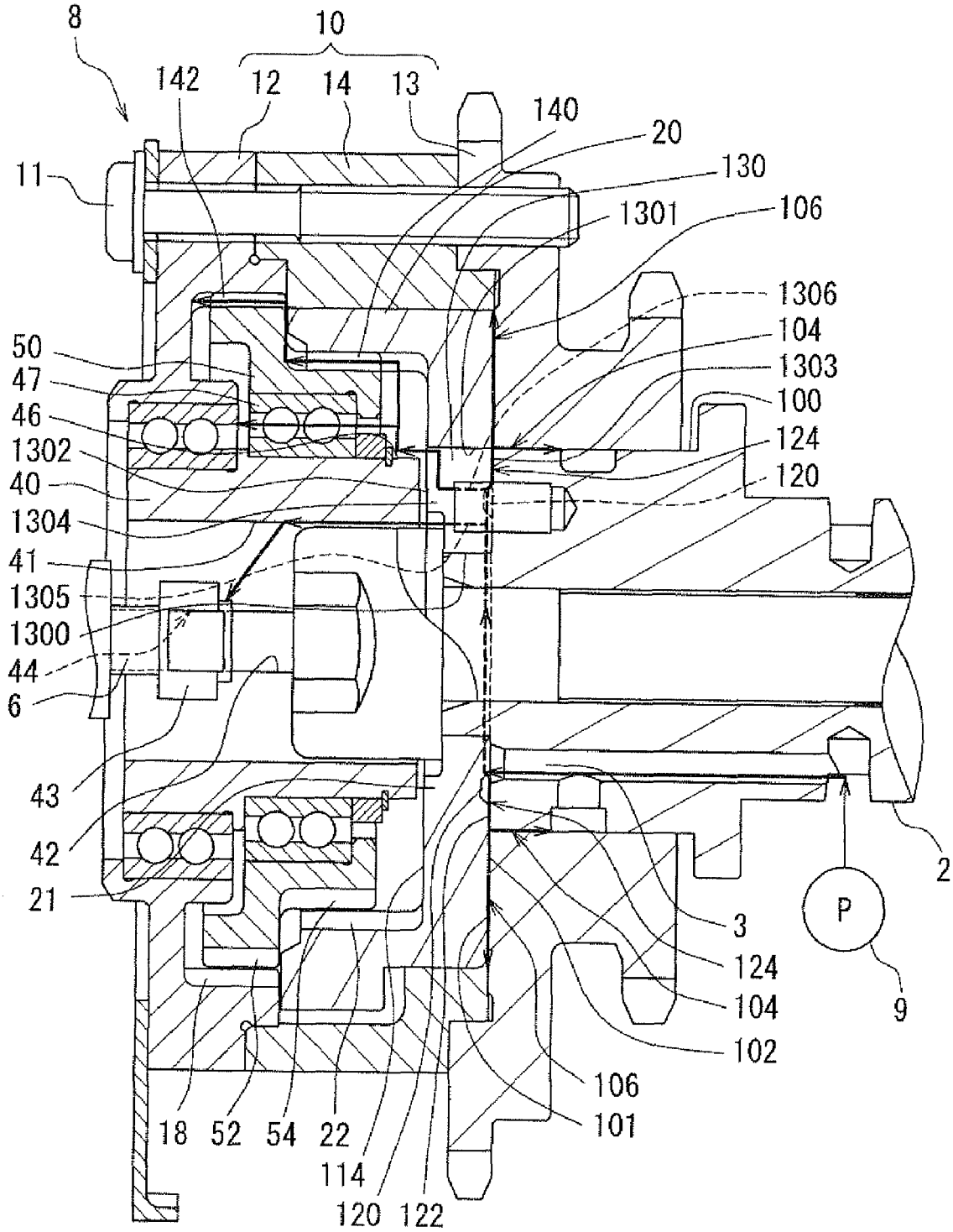
FIG. 6 is a cross-sectional view for explaining a lubricant flow in the phase adjustment mechanism illustrated in FIG. 4.

The camshaft 2 has a lubricant passage 3 therein, which communicates with the annular groove 120. The lubricant passage 3 extends in the axial direction of the camshaft 2 and communicates with an oil pump 9. The lubricant discharged from the oil pump 9 flows through the lubricant passage 3 to be supplied to the annular groove 120, as shown in FIG. 6. Then, the lubricant in the annular groove 120 flows through an interface 124 between the stepped surface 122 and the driven-rotor-side-surface 102 to be introduced to the supporting interface 104. Further, the lubricant is introduced into the sliding surface 106 over the entire circumference thereof.

Furthermore, as shown in FIGS. 4 and 5, the connection portion 21 has an introducing port 130 which has a radially inside opening 1300 opened at an inner periphery surface 1120 of the through-hole 112. The introducing port 130 is U-shaped in cross-section and has a bottom portion 1301. This introducing port 130 penetrates the connection portion 21 of the driven rotor 20 and is opened at the side surfaces 102, 114 of the connection portion 21. It should be noted that the inner diameter of the through-hole 112 is smaller than that of the connecting inner surface 41 of the planetary carrier 40. Moreover, an outermost point 1301*a* of the bottom portion 1301 with respect to a center line "O" of the rotors 10, 20 is positioned apart from a maximum eccentric point 132 (refer to FIGS. 2 and 3) of the supporting outer surface 46 of the planetary carrier 40. The outermost point 1301*a* is positioned on a line representing the periphery surface 100 of the camshaft 2.

The radially inside opening 1300 of the introducing port 130 is located radially inside relative to the connecting inner surface 41 of the planetary carrier 40. The bottom portion 1301 is located radially outside relative to the maximum eccentric point 132. Thus, a first side-opening 1302 of the introducing port 130 on a driven-rotor-inner-surface 114 extends across the connecting inner surface 41 and the maximum eccentric point 132. In other words, on the driven-rotor-inner-surface 114, the introducing port 130 extends across the connecting inner surface 41 and the supporting outer surface 46. On the driven-rotor-side-surface 102, an outermost point of second side-opening 1303 of the introducing port 130 reaches the supporting interface 104.

The introducing port 130 communicates with the annular groove 120. It should be noted that a communicating point between the introducing port 130 and the annular groove 120 is located opposite to a communication point between the lubricant passage 3 and the annular groove 120 with respect to the center line "O". These communicating points circumferentially deviate from each other by 180° around the center line "O". Furthermore, the columnar locating pin 118 divides an interior space of the introducing port 130 into three spaces 1304, 1305, 1306.

According to the above configuration, as shown in FIG. 6, the lubricant flows into the spaces 1305, 1306, and then flows into the space 1304. Further, the lubricant is introduced from the first side-opening 1302 toward the inner periphery of the driven rotor 20.

In the present embodiment, as shown in FIG. 6, the lubricant is always introduced to the connecting interface 44, the ball bearing 47, and the planetary gear 50. The lubricant can be introduced into a first engaging interface 140 between gears 22, 54 and a second engaging interface 142 between gears 18, 52. Furthermore, the lubricant in the space 1306 can be introduced into the supporting interface 104 and the sliding interface 106.

As described above, according to the first embodiment, the lubricant can be introduced into a plurality of interfaces 140, 142, 104, 106 and the ball baring 47, so that high lubricating property can be achieved with the simple lubricating configuration including the introducing port 130 and the annular groove 120 which are utilized in common with respect to the interfaces 140, 142, 104, 106 and the ball bearing 47. Thus, a deterioration in productivity and an increase in productive cost can be restricted.

Furthermore, according to the first embodiment, if the driven rotor 20 having the connecting portion 21 is formed by sintering metallic material or forging metallic material, the introducing port 130 and the annular groove 120 can be easily formed. Thus, a deterioration in productivity and an increase in productive cost can be restricted.

Furthermore, according to the first embodiment, the introducing port 130 has a function of introducing the lubricant and a function of locating the driven rotor 20 in cooperation with the columnar locating pin 118. Since the introducing port 130 has the spaces 1304, 1305, and 1306 therein, the columnar locating pin 118 does not interrupt the function of introducing the lubricant. Thus, the high lubricating property is kept by a simple configuration including the lubricating configuration.

According to the first embodiment, the annular groove 120 receives the lubricant from the lubricant passage 3 which is located opposite to the introducing port 130 with respect to the center line "O". The lubricant flows through each half-round of annular groove 120 toward the introducing port 130. Thus, even if the annular groove 120 is clogged with foreign matters in one of half-round of annular groove 120*a*, the lubricant can be introduced to the introducing port 130 through the other half-round of annular groove 120*a*. It can be avoided that the lubricating property is deteriorated due to a fault in the lubricating configuration.

In the above first embodiment, the introducing port 130 and the annular groove 120 correspond to "lubricating means", the driving rotor 10 corresponds to "first rotor", and the driven rotor 20 corresponds to "second rotor" of the present invention. The driving-side internal gear 18 corresponds to "first gear portion", the driven-side internal gear 22 corresponds to "second gear portion", the driving-side external gear 52 corresponds to "third gear portion", and the driven-side external gear 54 corresponds to "fourth gear portion" of the present invention.

Second Embodiment

Figure 7:
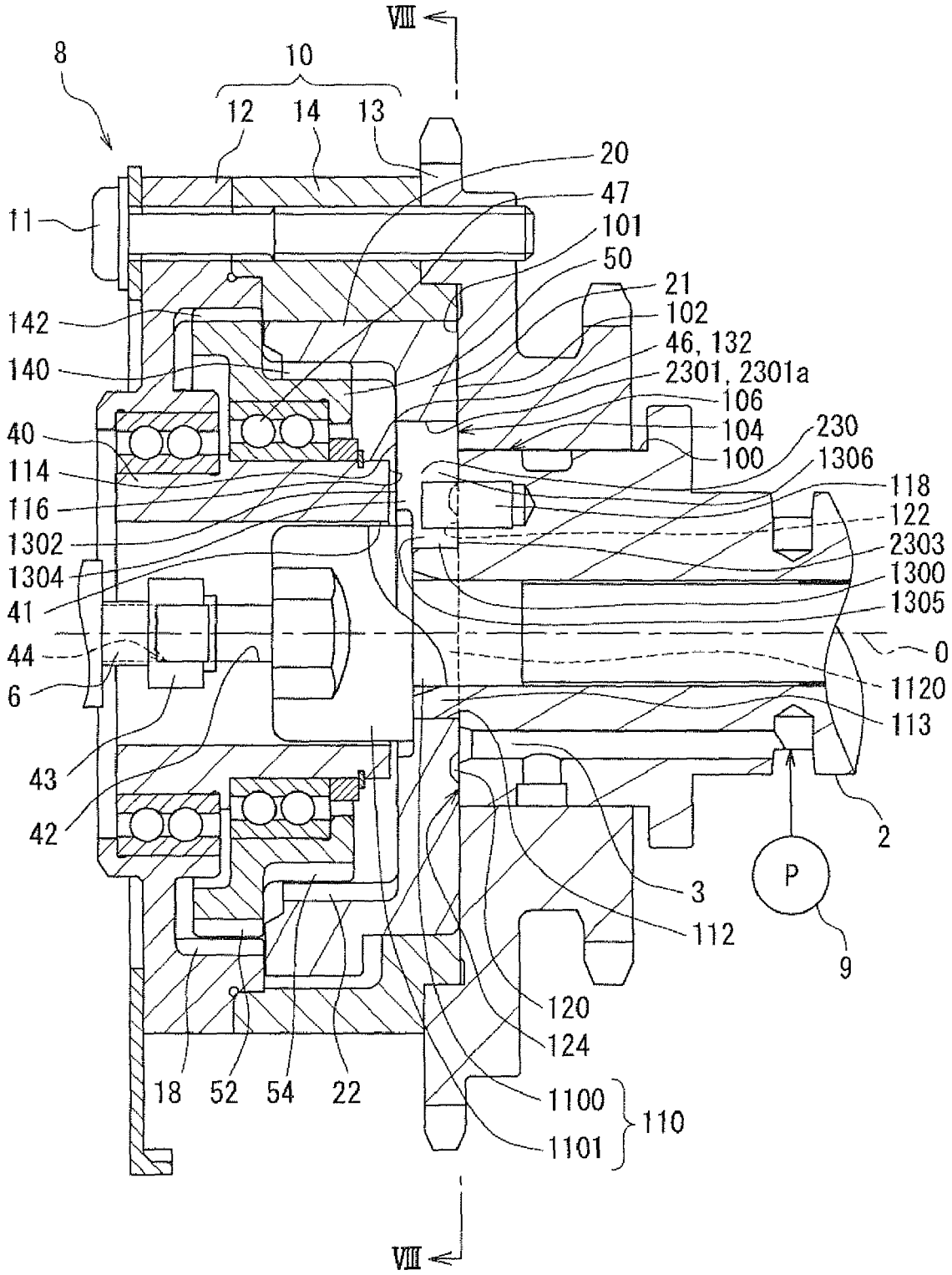
FIG. 7 is a cross-sectional view illustrating an enlarged phase adjustment mechanism of a valve timing adjusting apparatus according to a second embodiment of the present invention.
Figure 8:
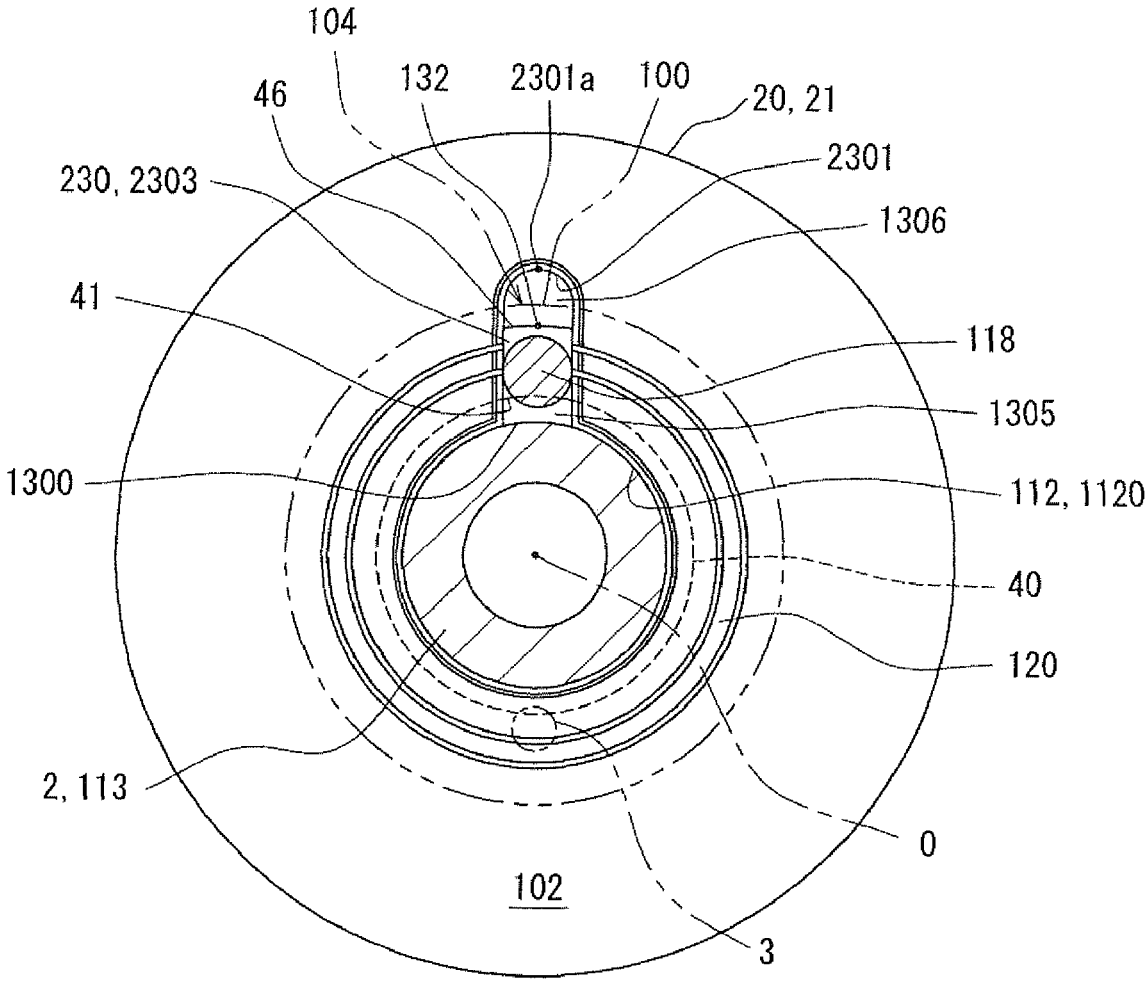
FIG. 8 is a cross-sectional view taken along a line VIII-VIII in FIG. 7, showing an essential part of the phase adjustment mechanism.

As shown in FIGS. 7 and 8, a second embodiment is a modification of the first embodiment. In the second and the successive embodiments, the same parts and components as those in the first embodiment are indicated with the same reference numerals and the same descriptions will not be reiterated. An outermost point 2301*a* of a bottom portion 2301 of the introducing port 230 is located apart from the maximum eccentric point 132 of the supporting outer surface 46 and the periphery surface 100 of the camshaft 2 with respect to the center line "O". The introducing port 230 has a bottom portion 2301 which is radially outwardly located with respect to the periphery surface 100 of the camshaft 2. Thus, a second side-opening 2303 of the introducing port 230 on the driven-rotor-side-surface 102 radially extends across the supporting interface 104.

Figure 9:
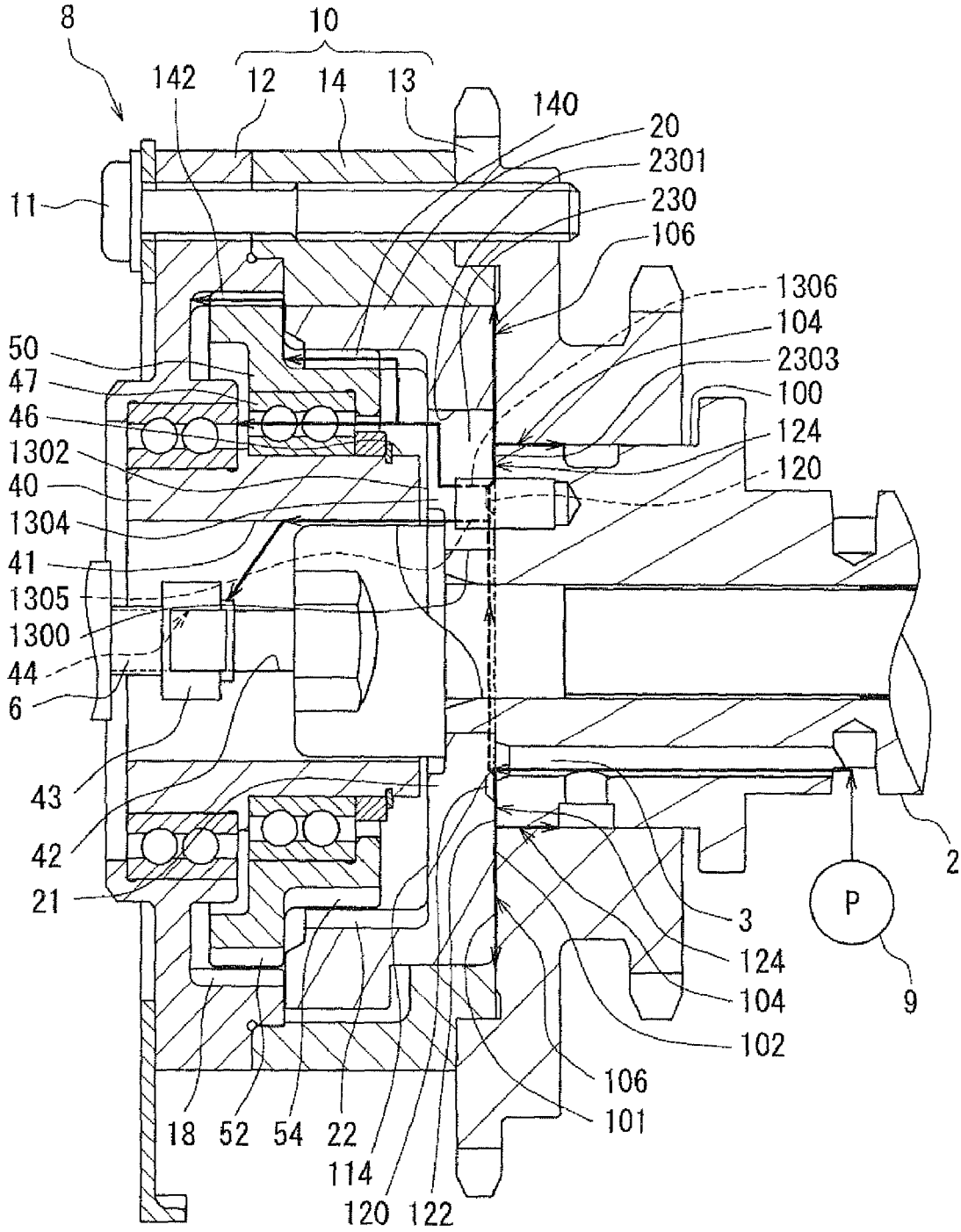
FIG. 9 is a cross-sectional view for explaining a lubricant flow in the phase adjustment mechanism illustrated in FIG. 7.

According to such a configuration, the lubricant in the space 1306 is easily introduced into the supporting interface 104 and the sliding surface 106, as shown in FIG. 9. Thus, the lubricating property can be enhanced by a simple lubricating configuration.

In the second embodiment, the introducing port 230 and the annular groove 120 corresponds to "lubricating means".

Third Embodiment

Figure 10:
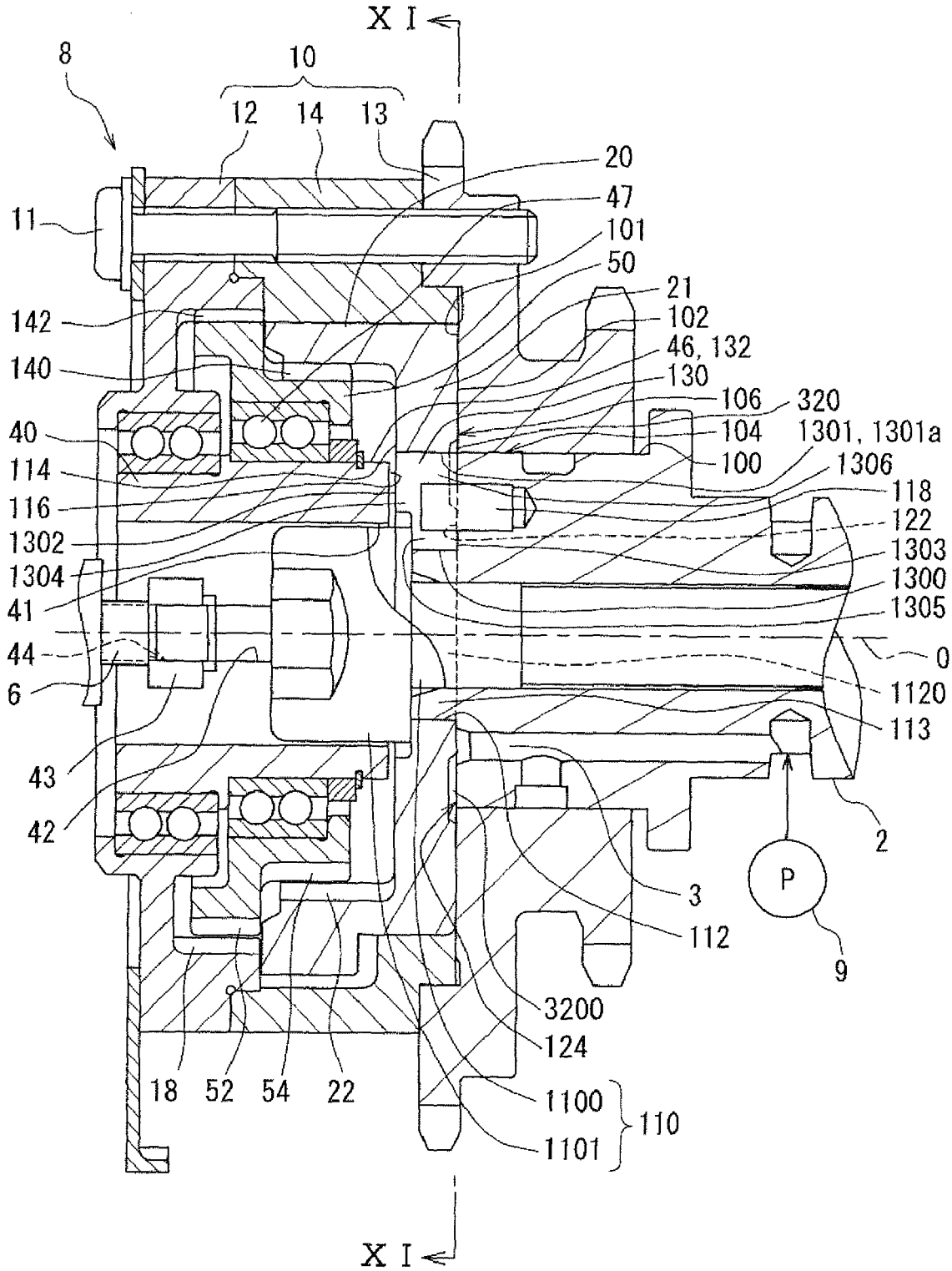
FIG. 10 is a cross-sectional view illustrating an enlarged phase adjustment mechanism of a valve timing adjusting apparatus according to a third embodiment of the present invention.
Figure 11:
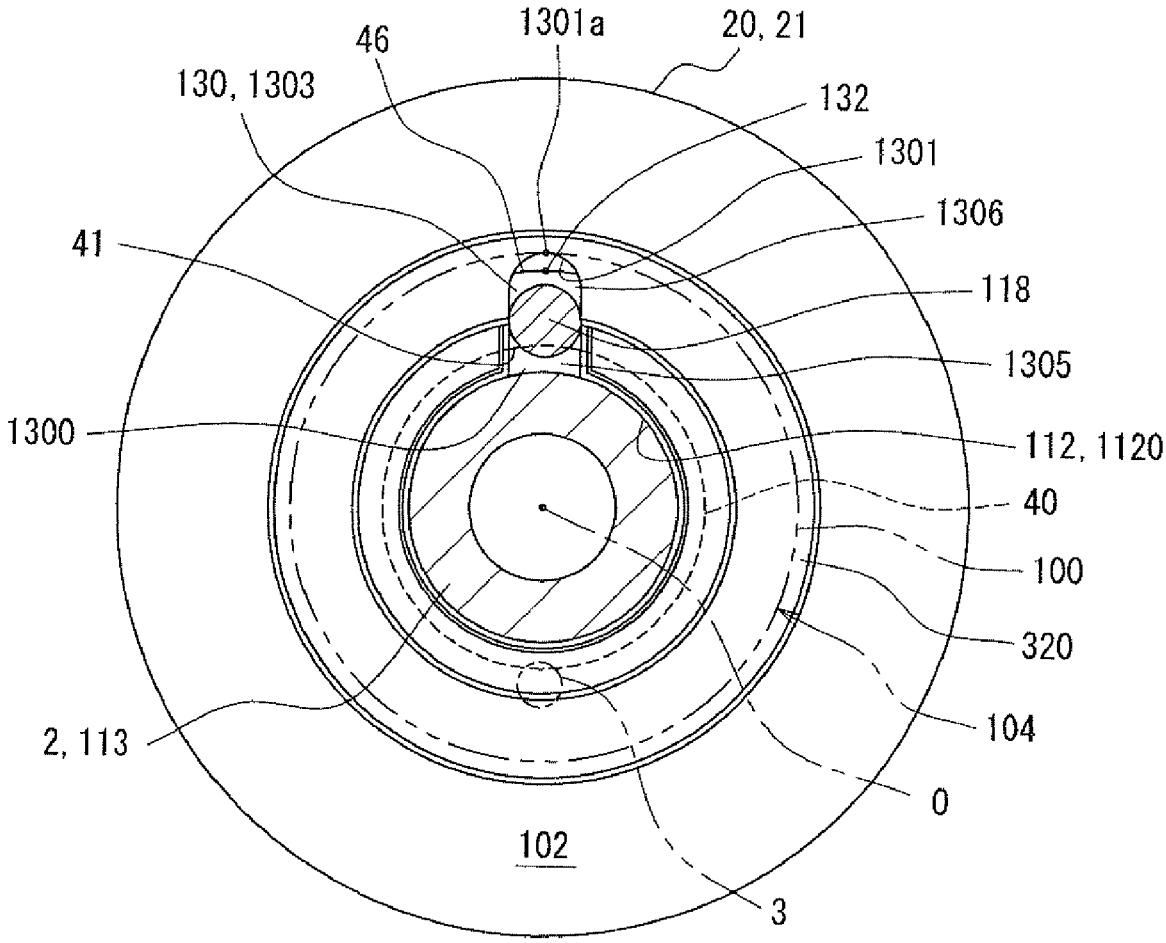
FIG. 11 is a cross-sectional view taken along a line XI-XI in FIG. 10, showing an essential part of the phase adjustment mechanism.

As shown in FIGS. 10 and 11, a third embodiment is a modification of the first embodiment. In the third embodiment, an outermost diameter of the annular groove 320 is larger than a diameter of the periphery surface 100 of the camshaft 2, which defines the supporting interface 104 in cooperation with the sprocket member 13. Also, the outermost radius of the annular groove 320 is larger than a distance between the outermost point 1301*a* and the center line "O". Thus, a width of an opening 3200 of the annular groove 320 on the driven-rotor-side-surface 102 radially extends across the supporting interface 104. The stepped surface 122 of the camshaft 2 is in contact with the driven-rotor-side-surface 102 inside of the annular groove 320.

Figure 12:
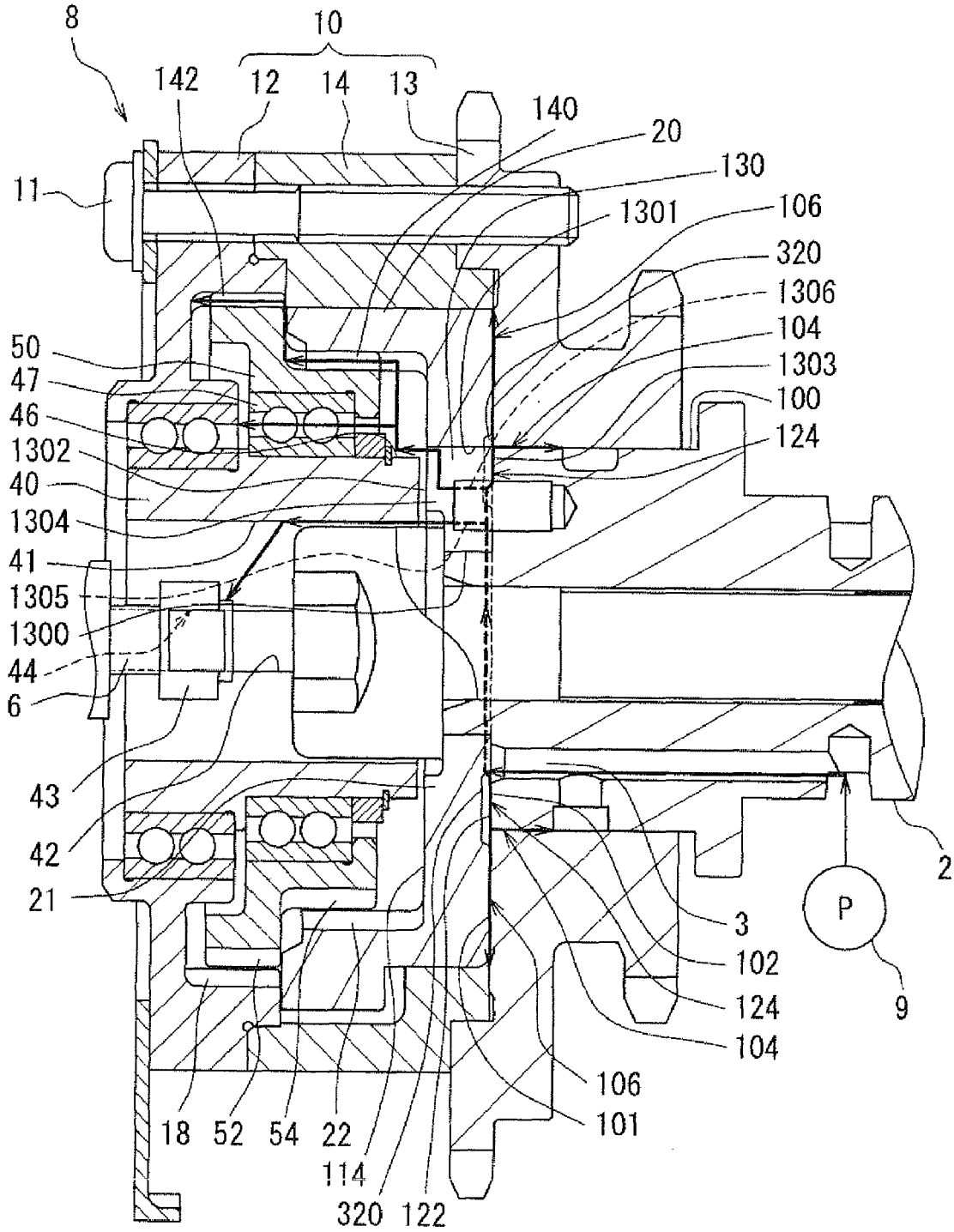
FIG. 12 is a cross-sectional view for explaining a lubricant flow in the phase adjustment mechanism illustrated in FIG. 10.

According to such a configuration, the annular groove 320 crossing the supporting interface 104 directly introduces the lubricant to the supporting interface 104 and the sliding interface 106, as shown in FIG. 12. Thus, the lubricating property can be enhanced by a simple lubricating configuration.

In the third embodiment, the introducing port 130 and the annular groove 320 corresponds to "lubricating means".

Other Embodiment

The present invention should not be limited to the disclosure embodiment, but may be implemented in other ways without departing from the sprit of the invention.

Specifically, in the first to third embodiments, the locating pin 118 may be inserted into a portion of the driven rotor 20 where the introducing port 130, 230 is not formed. In such a case, the introducing port 130, 230 may communicate with the lubricant passage 3 without forming the annular groove 120, 320. Moreover, in the third embodiment, the outermost point 1301*a* of the introducing port 130 may be located apart from the periphery surface 100 of the camshaft 2 with respect to the center line "O" in a similar way of the second embodiment.

In the first to third embodiments, the planetary gear 50 may be supported on the supporting outer surface 46 directly without the ball bearing 47. The driving rotor 10 may perform the interlocking rotation with the camshaft 2, and the driven rotor 20 may perform the interlocking rotation with the crankshaft. The electric actuator 4 may be an electric brake.

The present invention is applicable also to a controller which adjusts the valve timing of the exhaust valve, and a controller which adjusts the valve timing of the intake valve and the exhaust valve.

What is claimed is:

1. A valve timing controller which adjusts a valve timing of a valve opened/closed by a torque transmitted from a crankshaft to a camshaft of an internal combustion engine, the valve timing controller comprising:

a first rotor rotating along with one of the crankshaft and the camshaft;

a second rotor accommodated in the first rotor and rotating along with the other of the crankshaft and the camshaft;

a planetary gear accommodated in the first rotor and having an external gear engaging with an internal gear provided to the first rotor or the second rotor the planetary gear performing a planetary motion to adjust a relative rotational phase between the crankshaft and the camshaft;

a control shaft rotating for controlling the planetary motion;

a cylindrical planetary carrier accommodated in the first rotor and having a supporting outer surface which supports the planetary gear thereon, the cylindrical planetary carrier having a connecting inner surface to which the control shaft is connected so that the planetary gear performs the planetary motion according to a rotation of the control shaft;

a lubricating means having an introducing port which opens on a side surface of the second rotor axially confronting the planetary carrier, the introducing port extending across the supporting outer surface and the connecting inner surface, the lubricating means introducing a lubricant into an interior of the first rotor through the introducing port; and a fastening member fastening the second rotor to the camshaft, wherein the first rotor rotates along with the crankshaft, the second rotor rotates along with the camshaft, the second rotor is provided with a through-hole through which the fastening member is inserted, wherein the introducing port has a first side-opening confronting the planetary carrier and a radially inside opening communicating with the through-hole, and the introducing port has a bottom portion located radially outward relative to the radially inside opening and the supporting outer surface.

2. A valve timing controller which adjusts a valve timing of a valve opened/closed by a torque transmitted from a crankshaft to a camshaft of an internal combustion engine, the valve timing controller comprising:

a first rotor rotating along with one of the crankshaft and the camshaft;

a second rotor accommodated in the first rotor and rotating along with the other of the crankshaft and the camshaft;

a planetary gear accommodated in the first rotor and having an external gear engaging with an internal gear provided to the first rotor or the second rotor the planetary gear performing a planetary motion to adjust a relative rotational phase between the crankshaft and the camshaft;

a control shaft rotating for controlling the planetary motion;

a cylindrical planetary carrier accommodated in the first rotor and having a supporting outer surface which supports the planetary gear thereon, the cylindrical planetary carrier having a connecting inner surface to which the control shaft is connected so that the planetary gear performs the planetary motion according to a rotation of the control shaft;

a lubricating means having an introducing port which opens on a side surface of the second rotor axially confronting the planetary carrier, the introducing port extending across the supporting outer surface and the connecting inner surface, the lubricating means introducing a lubricant into an interior of the first rotor through the introducing port; and a locating member for locating the second rotor with respect to the camshaft which the second rotor rotates along with, wherein the locating member is inserted into the introducing port.

3. A valve timing controller according to claim 2, wherein the introducing port defines a space into which a lubricant flows.

4. A valve timing controller which adjusts a valve timing of a valve opened/closed by a torque transmitted from a crankshaft to a camshaft of an internal combustion engine, the valve timing controller comprising:

a first rotor rotating along with one of the crankshaft and the camshaft;

a second rotor accommodated in the first rotor and rotating along with the other of the crankshaft and the camshaft;

a planetary gear accommodated in the first rotor and having an external gear engaging with an internal gear provided to the first rotor or the second rotor the planetary gear performing a planetary motion to adjust a relative rotational phase between the crankshaft and the camshaft;

a control shaft rotating for controlling the planetary motion;

a cylindrical planetary carrier accommodated in the first rotor and having a supporting outer surface which supports the planetary gear thereon, the cylindrical planetary carrier having a connecting inner surface to which the control shaft is connected so that the planetary gear performs the planetary motion according to a rotation of the control shaft; and a lubricating means having an introducing port which opens on a side surface of the second rotor axially confronting the planetary carrier, the introducing port extending across the supporting outer surface and the connecting inner surface, the lubricating means introducing a lubricant into an interior of the first rotor through the introducing port, wherein the first rotor rotates along with the crankshaft, the second rotor rotates along with the camshaft, the introducing port has a second side-opening confronting the first rotor the second side-opening radially extending across a supporting interface between the first rotor and the camshaft.

5. A valve timing controller which adjusts a valve timing of a valve opened/closed by a torque transmitted from a crankshaft to a camshaft of an internal combustion engine, the valve timing controller comprising:

a first rotor rotating along with one of the crankshaft and the camshaft;

a second rotor accommodated in the first rotor and rotating along with the other of the crankshaft and the camshaft;

a planetary gear accommodated in the first rotor and having an external gear engaging with an internal gear provided to the first rotor or the second rotor the planetary gear performing a planetary motion to adjust a relative rotational phase between the crankshaft and the camshaft;

a control shaft rotating for controlling the planetary motion;

a cylindrical planetary carrier accommodated in the first rotor and having a supporting outer surface which supports the planetary gear thereon, the cylindrical planetary carrier having a connecting inner surface to which the control shaft is connected so that the planetary gear performs the planetary motion according to a rotation of the control shaft; and a lubricating means having an introducing port which opens on a side surface of the second rotor axially confronting the planetary carrier, the introducing port extending across the supporting outer surface and the connecting inner surface, the lubricating means introducing a lubricant into an interior of the first rotor through the introducing port, wherein the lubricating means includes an annular groove provided on a side surface of the second rotor, the annular groove extending in a rotational direction of the second rotor, the annular groove introducing the lubricant to the supporting interface.

6. A valve timing controller according to claim 5, wherein the annular groove has an annular opening extending across the supporting interface.

7. A valve timing controller according to claim 5, wherein the annular groove communicates with a lubricant passage provided in the camshaft through which a lubricant flows, the annular groove introduces the lubricant from a lubricant passage to the introducing port, and a communication point between the lubricant passage and the annular groove circumferentially deviates from the introducing port.

8. A valve timing controller which adjusts a valve timing of a valve opened/closed by a torque transmitted from a crankshaft to a camshaft of an internal combustion engine, the valve timing controller comprising:

a first rotor rotating along with one of the crankshaft and the camshaft;

a second rotor accommodated in the first rotor and rotating along with the other of the crankshaft and the camshaft;

a planetary gear accommodated in the first rotor and having an external gear engaging with an internal gear provided to the first rotor or the second rotor the planetary gear performing a planetary motion to adjust a relative rotational phase between the crankshaft and the camshaft;

a control shaft rotating for controlling the planetary motion;

a cylindrical planetary carrier accommodated in the first rotor and having a supporting outer surface which supports the planetary gear thereon, the cylindrical planetary carrier having a connecting inner surface to which the control shaft is connected so that the planetary gear performs the planetary motion according to a rotation of the control shaft; and a lubricating means having an introducing port which opens on a side surface of the second rotor axially confronting the planetary carrier, the introducing port extending across the supporting outer surface and the connecting inner surface, the lubricating means introducing a lubricant into an interior of the first rotor through the introducing port, wherein the camshaft and the first rotor defines a supporting interface therebetween, and the second rotor and the first rotor define a sliding interface therebetween which radially extends from the supporting interface.

9. A valve timing controller which adjusts a valve timing of a valve opened/closed by a torque transmitted from a crankshaft to a camshaft of an internal combustion engine, the valve timing controller comprising:

a first rotor rotating along with one of the crankshaft and the camshaft;

a second rotor accommodated in the first rotor and rotating along with the other of the crankshaft and the camshaft;

a planetary gear accommodated in the first rotor and having an external gear engaging with an internal gear provided to the first rotor or the second rotor the planetary gear performing a planetary motion to adjust a relative rotational phase between the crankshaft and the camshaft;

a control shaft rotating for controlling the planetary motion;

a cylindrical planetary carrier accommodated in the first rotor and having a supporting outer surface which supports the planetary gear thereon, the cylindrical planetary carrier having a connecting inner surface to which the control shaft is connected so that the planetary gear performs the planetary motion according to a rotation of the control shaft; and a lubricating means having an introducing port which opens on a side surface of the second rotor axially confronting the planetary carrier, the introducing port extending across the supporting outer surface and the connecting inner surface, the lubricating means introducing a lubricant into an interior of the first rotor through the introducing port, wherein the first rotor is provided with a first gear portion, the second rotor is provided with a second gear portion, and the planetary gear is provided with a third gear portion and a fourth gear portion which respectively engage with the first gear portion and the second gear portion.

* * * * *